US009502018B2

(12) United States Patent
Cronin et al.

(10) Patent No.: US 9,502,018 B2
(45) Date of Patent: Nov. 22, 2016

(54) WHISTLE PLAY STOPPER

(71) Applicant: ProSports Technologies, LLC, Miami, FL (US)

(72) Inventors: John E. Cronin, Bonita Springs, FL (US); Nick Reasner, Chicago, IL (US)

(73) Assignee: PROSPORTS TECHNOLOGIES, LLC, Miami, FL (US)

( * ) Notice: Subject to any disclaimer, the term of this patent is extended or adjusted under 35 U.S.C. 154(b) by 0 days.

(21) Appl. No.: 14/798,049

(22) Filed: Jul. 13, 2015

(65) Prior Publication Data

US 2016/0012810 A1 Jan. 14, 2016

Related U.S. Application Data

(60) Provisional application No. 62/023,393, filed on Jul. 11, 2014.

(51) Int. Cl.

| | |
|---|---|
| ***G10K 5/00*** | (2006.01) |
| ***A63B 71/06*** | (2006.01) |
| ***G04G 21/00*** | (2010.01) |
| ***G08B 7/00*** | (2006.01) |
| ***G07C 1/22*** | (2006.01) |
| ***G07C 1/28*** | (2006.01) |

(52) U.S. Cl.

CPC ..... *G10K 5/00* (2013.01); *A63B 71/06* (2013.01); *G04G 21/00* (2013.01); *G07C 1/22* (2013.01); *G07C 1/28* (2013.01); *G08B 7/00* (2013.01)

(58) Field of Classification Search

None

See application file for complete search history.

(56) References Cited

U.S. PATENT DOCUMENTS

| | | | |
|---|---|---|---|
| 4,763,284 | A | 8/1988 | Carlin |
| 4,771,394 | A | 9/1988 | Cavanagh |
| 5,293,354 | A | 3/1994 | Costabile |
| 5,462,275 | A | 10/1995 | Lowe et al. |
| 6,013,007 | A | 1/2000 | Root et al. |
| 6,181,236 | B1 | 1/2001 | Schneider |
| 6,389,368 | B1 | 5/2002 | Hampton |
| 6,603,711 | B2 | 8/2003 | Calace |
| 6,760,276 | B1 | 7/2004 | Karr |
| 6,836,744 | B1 | 12/2004 | Asphahani et al. |
| 7,020,336 | B2 | 3/2006 | Cohen-Solal et al. |
| 7,031,225 | B2 | 4/2006 | McDonald |

(Continued)

FOREIGN PATENT DOCUMENTS

| | | |
|---|---|---|
| AU | 2014100006 | 2/2014 |
| CN | 102527007 | 7/2012 |

(Continued)

OTHER PUBLICATIONS

"About Head Case", Head Case Company, Sep. 24, 2013.

(Continued)

*Primary Examiner* — Mohamed Barakat
(74) *Attorney, Agent, or Firm* — Polsinelli LLP

(57) ABSTRACT

Systems and methods for notifying game-based clocks and players associated with a sporting event using one or more digital whistles are described. More specifically, the one or more digital whistles, for example used by referees, transmit one or more digital signals upon being used. The transmitted digital signals are received by a whistle processor that processes the transmitted digital signals and transmits instructions to the game-based clocks and players in the sporting event for controlling timekeeping and facilitating a flow of the sporting event.

18 Claims, 4 Drawing Sheets

FIGURE 1 – Digital Whistle Game Clock and Player Signaling System

(56) References Cited

U.S. PATENT DOCUMENTS 7,115,053 B2 10/2006 Meichner
7,173,533 B1 * 2/2007 Beron ..... G08B 1/08 340/4.12
7,174,277 B2 2/2007 Vock et al.
7,561,494 B2 7/2009 Stern
7,561,723 B2 7/2009 Goldberg et al.
7,602,301 B1 10/2009 Stirling et al.
7,618,312 B1 11/2009 Kasten
7,634,662 B2 12/2009 Monroe
7,693,668 B2 4/2010 Vock et al.
7,715,723 B2 5/2010 Kagawa et al.
7,805,149 B2 9/2010 Werner et al.
7,920,052 B2 4/2011 Costabile
8,054,174 B1 11/2011 Uehran
8,098,881 B2 1/2012 Camp et al.
8,239,146 B2 8/2012 Vock et al.
8,253,586 B1 8/2012 Matak
8,257,084 B1 9/2012 Kreiner et al.
8,257,228 B2 9/2012 Quartrochi et al.
8,289,185 B2 10/2012 Alonso
8,326,136 B1 12/2012 Clark
8,396,687 B2 3/2013 Vock et al.
8,477,046 B2 7/2013 Alonso
8,485,879 B2 7/2013 Lin et al.
8,554,495 B2 10/2013 Mack et al.
8,554,509 B2 10/2013 Crisco et al.
8,579,632 B2 11/2013 Crowley
8,589,667 B2 11/2013 Mujtaba et al.
8,611,930 B2 12/2013 Louboutin et al.
8,620,344 B2 12/2013 Huang et al.
8,626,465 B2 1/2014 Moore et al.
8,630,216 B2 1/2014 Deivasigamani et al.
8,660,501 B2 2/2014 Sanguinetti
8,684,819 B2 4/2014 Thomas et al.
8,702,504 B1 4/2014 Hughes et al.
8,706,044 B2 4/2014 Chang et al.
8,724,723 B2 5/2014 Panicker et al.
8,750,207 B2 6/2014 Jeong et al.
8,793,094 B2 7/2014 Tam et al.
8,816,868 B2 8/2014 Tan et al.
8,831,529 B2 9/2014 Toh et al.
8,831,655 B2 9/2014 Burchill et al.
8,836,851 B2 9/2014 Brunner
8,843,158 B2 9/2014 Nagaraj
8,849,308 B2 9/2014 Marti et al.
8,862,060 B2 10/2014 Mayor
8,873,418 B2 10/2014 Robinson et al.
8,874,090 B2 10/2014 Abuan et al.
8,917,632 B2 12/2014 Zhou et al.
8,934,921 B2 1/2015 Marti et al.
8,994,498 B2 3/2015 Agrafioti et al.
9,305,441 B1 4/2016 Cronin
9,398,213 B1 7/2016 Cronin
2001/0003715 A1 6/2001 Jutzi et al.
2001/0048484 A1 12/2001 Tamir et al.
2003/0163287 A1 8/2003 Vock et al.
2003/0210612 A1 * 11/2003 Stern ..... A63B 71/06 368/110
2005/0046584 A1 3/2005 Breed
2005/0117022 A1 6/2005 Marchant
2005/0162257 A1 * 7/2005 Gonzalez ..... A63B 24/0021 340/323 R
2005/0242508 A1 11/2005 Meichner
2005/0277466 A1 12/2005 Lock
2006/0052147 A1 3/2006 Matthews
2006/0109089 A1 5/2006 Boehm et al.
2006/0180073 A1 8/2006 Nakamoto
2006/0208169 A1 9/2006 Breed et al.
2006/0281061 A1 12/2006 Hightower et al.
2007/0003113 A1 1/2007 Goldberg
2007/0135264 A1 6/2007 Rosenberg
2007/0269203 A1 11/2007 Awazu
2008/0082311 A1 4/2008 Meijer et al.
2008/0129825 A1 6/2008 DeAngelis et al.
2008/0146302 A1 6/2008 Olsen et al.
2009/0023122 A1 1/2009 Lieberman et al.
2009/0029754 A1 1/2009 Slocum et al.
2009/0111582 A1 4/2009 Schuler et al.
2009/0256912 A1 10/2009 Rosenberg
2010/0026809 A1 2/2010 Curry
2010/0030350 A1 2/2010 House et al.
2010/0102938 A1 * 4/2010 Delia ..... A63B 71/0619 340/326
2010/0105503 A1 4/2010 Daisher et al.
2010/0144414 A1 6/2010 Edis et al.
2010/0185398 A1 7/2010 Berns et al.
2010/0283630 A1 11/2010 Alonso
2011/0013087 A1 1/2011 House et al.
2011/0064281 A1 3/2011 Chan
2011/0169959 A1 7/2011 DeAngelis et al.
2011/0181418 A1 7/2011 Mack et al.
2011/0184320 A1 7/2011 Shipps et al.
2012/0002509 A1 * 1/2012 Saguin ..... A63B 71/0616 368/3
2012/0029666 A1 2/2012 Crowley et al.
2012/0052947 A1 3/2012 Yun
2012/0063272 A1 3/2012 Dorais et al.
2012/0081531 A1 4/2012 DeAngelis et al.
2012/0099405 A1 * 4/2012 Lidor ..... A63B 71/0669 368/10
2012/0116548 A1 5/2012 Goree et al.
2012/0120201 A1 5/2012 Ward
2012/0124720 A1 5/2012 Evans et al.
2012/0166449 A1 6/2012 Pitaliya
2012/0197998 A1 8/2012 Kessel et al.
2012/0202594 A1 8/2012 Bistis et al.
2012/0212505 A1 8/2012 Burroughs et al.
2012/0223833 A1 9/2012 Thomas et al.
2012/0324491 A1 12/2012 Bathiche et al.
2013/0018494 A1 1/2013 Amini
2013/0045806 A1 2/2013 Bloodworth
2013/0060138 A1 3/2013 Chiodo
2013/0066448 A1 3/2013 Alonso
2013/0080222 A1 3/2013 Quinn
2013/0091209 A1 4/2013 Bennett et al.
2013/0095924 A1 4/2013 Geisner et al.
2013/0126713 A1 5/2013 Haas et al.
2013/0138590 A1 5/2013 Huke et al.
2013/0139068 A1 5/2013 Bowring
2013/0141555 A1 6/2013 Ganick et al.
2013/0166048 A1 6/2013 Werner et al.
2013/0222133 A1 8/2013 Schultz et al.
2013/0235702 A1 9/2013 Saguin et al.
2013/0249708 A1 9/2013 Moll-Carrillo et al.
2013/0279917 A1 10/2013 Son et al.
2013/0303192 A1 11/2013 Louboutin
2013/0316837 A1 11/2013 Coiner, Jr.
2013/0317835 A1 11/2013 Mathew
2013/0322689 A1 12/2013 Carmichael
2013/0324239 A1 12/2013 Ur et al.
2013/0328917 A1 12/2013 Zambetti et al.
2013/0331087 A1 12/2013 Shoemaker
2013/0331118 A1 12/2013 Chhabra
2013/0331137 A1 12/2013 Burchill
2013/0332108 A1 12/2013 Patel
2013/0332156 A1 12/2013 Tackin
2013/0335635 A1 12/2013 Ghanem et al.
2013/0336662 A1 12/2013 Murayama et al.
2013/0343762 A1 12/2013 Murayama et al.
2014/0004939 A1 1/2014 Kasten
2014/0039354 A1 2/2014 Greenwald et al.
2014/0039355 A1 2/2014 Crisco et al.
2014/0039651 A1 2/2014 Crowley
2014/0062773 A1 3/2014 MacGougan
2014/0065962 A1 3/2014 Le
2014/0068847 A1 3/2014 Kitowski
2014/0071221 A1 3/2014 Dave
2014/0080638 A1 3/2014 Feng et al.
2014/0088454 A1 3/2014 Mack
2014/0105084 A1 4/2014 Chhabra
2014/0105466 A1 4/2014 Botes et al.
2014/0107817 A1 4/2014 Ellis et al.
2014/0111352 A1 4/2014 Doherty
2014/0125702 A1 5/2014 Santillan et al.

(56) References Cited

U.S. PATENT DOCUMENTS

| | | | |
|---|---|---|---|
| 2014/0139380 | A1 | 5/2014 | Ouyang |
| 2014/0141803 | A1 | 5/2014 | Marti |
| 2014/0143940 | A1 | 5/2014 | Luliano et al. |
| 2014/0155178 | A1 | 6/2014 | Bloodworth |
| 2014/0162628 | A1 | 6/2014 | Bevelacqua |
| 2014/0167794 | A1 | 6/2014 | Nath |
| 2014/0168170 | A1 | 6/2014 | Lazarescu |
| 2014/0168477 | A1 | 6/2014 | David |
| 2014/0171114 | A1 | 6/2014 | Marti |
| 2014/0180820 | A1 | 6/2014 | Louboutin |
| 2014/0191979 | A1 | 7/2014 | Tsudik |
| 2014/0200053 | A1 | 7/2014 | Balasubramanian |
| 2014/0218184 | A1 | 8/2014 | Grant et al. |
| 2014/0222335 | A1 | 8/2014 | Piemonte |
| 2014/0232633 | A1 | 8/2014 | Shultz |
| 2014/0232634 | A1 | 8/2014 | Piemonte |
| 2014/0241730 | A1 | 8/2014 | Jovicic et al. |
| 2014/0247279 | A1 | 9/2014 | Nicholas |
| 2014/0247280 | A1 | 9/2014 | Nicholas |
| 2014/0269562 | A1 | 9/2014 | Burchill |
| 2014/0270375 | A1 | 9/2014 | Canavan et al. |
| 2014/0274150 | A1 | 9/2014 | Marti |
| 2014/0278218 | A1 | 9/2014 | Chang |
| 2014/0283135 | A1 | 9/2014 | Shepherd |
| 2014/0293959 | A1 | 10/2014 | Singh |
| 2014/0361906 | A1 | 12/2014 | Hughes et al. |
| 2014/0363168 | A1 | 12/2014 | Walker |
| 2014/0364089 | A1 | 12/2014 | Lienhart |
| 2014/0364148 | A1 | 12/2014 | Block |
| 2014/0365120 | A1 | 12/2014 | Vulcano |
| 2014/0365194 | A1 | 12/2014 | O'Hagan et al. |
| 2014/0365640 | A1 | 12/2014 | Wohl et al. |
| 2014/0371887 | A1 | 12/2014 | Hoffman et al. |
| 2014/0375217 | A1 | 12/2014 | Feri et al. |
| 2015/0011242 | A1 | 1/2015 | Nagaraj |
| 2015/0026623 | A1 | 1/2015 | Horne et al. |
| 2015/0031397 | A1 | 1/2015 | Jouaux |
| 2015/0081713 | A1 | 3/2015 | Alonso et al. |
| 2015/0131845 | A1 | 5/2015 | Forouhar et al. |
| 2015/0187188 | A1 | 7/2015 | Raskin |
| 2015/0296272 | A1 | 10/2015 | Sonabend et al. |
| 2015/0306457 | A1 | 10/2015 | Crankson et al. |
| 2016/0001159 | A1 | 1/2016 | Riley et al. |
| 2016/0008693 | A1 | 1/2016 | Cronin |
| 2016/0073010 | A1 | 3/2016 | Cronin |
| 2016/0096074 | A1 | 4/2016 | Moll-Carrillo et al. |
| 2016/0107064 | A1 | 4/2016 | Hoffman et al. |

FOREIGN PATENT DOCUMENTS

| | | |
|---|---|---|
| CN | 102843186 | 12/2012 |
| EP | 2 407 218 | 1/2012 |
| WO | WO 2008/030484 | 3/2008 |
| WO | WO 2009/104921 | 8/2009 |
| WO | WO 2011/004381 | 1/2011 |
| WO | WO 2012/100053 | 7/2012 |
| WO | WO 2013/011259 | 1/2013 |
| WO | WO 2013/166456 | 11/2013 |
| WO | WO 2014/008134 | 1/2014 |
| WO | WO 2014/052874 | 4/2014 |
| WO | WO 2014/100519 | 6/2014 |
| WO | WO 2016/007969 | 1/2016 |
| WO | WO 2016/007970 | 1/2016 |
| WO | WO 2016/039991 | 3/2016 |

OTHER PUBLICATIONS

"adidas' miCoach SPEED_CELL and miCoach Football App Aim to Advance the Performance of Next-Generation Athletes Through New Technology", miCoach, Nov. 22, 2011.

"Advanced E-Team: Automatic Sports Time Stopping Whistle", Rose-Hulman Institute of Technology, 2002, NCIIA Funded Advanced E-Teams. Date of Download: Jun. 14, 2014. http://www.nciia.org/WebObjects/NciiaResources.woa/waNiew/GrantProfile?n=1000037.

"Affordable Concussion Management System for Young Athletes Offered by Head Case", Head Case Company, Sep. 24, 2013.

Ancona et al., N.; "Goal detection in football by using Support Vector Machines for classification" Neural Networks, vol. 1, pp. 611-616, 2001.

"AutoScout" ADSC Illinous at Singapore Pte Ltd. Sep. 21, 2015.

Belzer, Jason; "NFL Partners With Zebra Technologies to Provide Next Generation Player Tracking", Forbes/Sports Money, Jul. 31, 2014.

Brolinson et al., P. Gunner; "Analysis of Linear Head Accelerations from Collegiate Football Impacts", Current Sports Medicine Reports, 2006, vol. 5:23-28.

"Chapter 29. Outdoor Laser Operations", U.S. Department of Transportation, Feb. 9, 2012.

Cooley, Chris; "MMQB: Smart Football", The Official Blog of Chris Cooley, Jul. 13, 2009.http://chriscooley47.blogspot.com/2009/07/mmqb-smart-football.html.

"Create Innovative Services with Play Apps", Date of Download: Jan. 16, 2014, http://www.oledcomm.com/LIFI.html, Oledcomm—France LiFi.

Danakis, C et al.; "Using a CMOS Camera Sensor for Visible Light Communication"; 3rd IEEE Workshop on Optical Wireless Communications; [online], Dec. 3-7, 2012 [retrieved Aug. 14, 2015]. Retrieved from the Internet: <URL: https://195.134.65.236/IEEE_Globecom_2012/papers/p1244-danakis.pdf> pp. 1244-1248.

Dawson, Keith; "LiFi in the Real World" All LED Lighting—Illuminating The Led Community, Jul. 31, 2013.

Delgado, Rick; "Why Fantasy Football Is Embracing Big Data", Sporttechie, Jan. 3, 2014.

"Dutch Football Fans Get the Ajax Experience With AV Technology From Electrosonic", Electrosonic Press Release, May 14, 2012.

FAQ, Go Pro Workouts, Date of Download: Apr. 30, 2014 https://www.goproworkouts.com/faqs.

"First Down Laser Systems to enhance game of football and fans in-stadium experience with green line", Sports Techie, Sep. 9, 2013.

"Football Workout Programs", Go Pro Workouts. Date of Download: Apr. 27, 2014 https://www.goproworkouts.com/workouts/football.

Freeman, Mark; "Frickin' Laser Beams", River Valley Leader, Feb. 19, 2013.

Gerhardt, Ryan; "Concussion Sensing Helmet Could Save Athletes", PSFK, Oct. 28, 2013.

Gerhardt, Ryan; "Vibrating Jersey Lets Fans Feel What Players Do on the Field", PSFK.com, Mar. 13, 2014.

"GoalControl to provide goal-line system at World Cup in Brazil", BBC Sport, Apr. 2, 2013.

Gorman, Michael; "Outstanding Technology brings visible light communication to phones and tablets via dongle and LEDs", Edgadget International Editions, Jul. 16, 2012.

"Growing data sets alter Sportsvision's real-time viewing experience", Sports Illustrated, More Sports, Nov. 29, 2013.

Haas, Harald; "Delivering safe and secure wireless communications", pureLiFi. Date of download: Jan. 16, 2014 http://purelifi.co.uk/.

"How to compare personal stats with the Pros?", Support Home Discussions Training with miCoach. Jul. 4, 2012.

"How to wear the Stride Sensor (inside the shoe)", by micoach, Guides & Tutorials, May 29, 2014.

Inamoto et al., Naho; "Immersive Observation of Virtualized Soccer Match at Real Stadium Model", Proceedings of the Second IEEE and ACM International Symposium on Mixed and Augmented Reality (ISMAR '03), 2003.

"Intel, NFL Legend Jerry Rice and others Team Up to "Look Inside the Huddle" on and Off the Field", by INTELPR in Intel Newsroom, Aug. 28, 2013.

Kumar, Navin; "Visible Light Communications Systems Conception and VIDAS", IETE Technical Review, vol. 25, Issue 6, Nov.-Dec. 2008. Date of download: Nov. 19, 2009 http://www.tr.ietejournals.org.

La Confora, Jason; "NFL collecting data that could revolutionize websites, video games", CBS Sports—NFL Insider, Nov. 25, 2012.

(56) References Cited

OTHER PUBLICATIONS

Laviers, Kennard R.; Sukthankar, Gita; "Using Opponent Modeling to Adapt Team Play in American Football", Plan, Activity, and Recognition, Elsevier, 2014. School of ECE, Air Force Institute of Technology. Preprint submitted: Oct. 31, 2013.
LiFi Overview—Green wireless mobile communication—LiFi Technology. Date of download: Jan. 16, 2014.
Li, Yang et al., "VICO: A Framework for Configuring Indoor Visible Light Communication Networks" Aug. 11, 2012, Mobile Adhoc and Sensor Systems (MASS), 2012 IEEE 9th International Conference, Las Vegas, NV.
Macleod, Robert; "New football helmet sensors monitor brain injuries", The Globe and Mail, Nov. 14, 2013.
Madden, Lance; "Pro Athletes Share Personal Workout Secrets With Startup 'Go Pro Workouts'", Forbes.com, SportsMoney. Mar. 4, 2013.
Maricle, Charles; "Federal rules for outdoor laser user in the U.S. (FAA authority over airspace)", Laser PointerSafety.com, Apr. 23, 2014.
"Methods to Our Madness", Football Outsiders Information, Innovative Statistics, Intelligent Analysis, http://www.footballoutsiders.com/info/methods, Date of Download: Apr. 10, 2014.
Miller, Mark J.; "NFL Sensors Will Track Player Stats for Fans, but What About Safety?", Sports in the Spotlight—brandchannel, Aug. 11, 2014.
Montero, Eric, "Design and Implementation of Color-Shift Keying for Visible Light Communications", Sep. 2013, McMaster University.
Morgan, Debra; "Referee Uses Capital Idea to Stop Game Clocks on a Whistle", Loca News. Nov. 18, 1999. http://www.wral.com/news/local/story/138889.
Naidu, Vinaya; "Watched the IPL? Now Find and Tag Yourself in the Stadium With Vodafone Fancam", Business 2 Community, May 22, 2013.
"New courtside technology unveiled at PISD tourney", Precision Time Systems—New Inventions That Prevent Human Errors in Sports Timekeeping, Date of Download: Apr. 23, 2014.
Nguyen et al., "A Novel like switching scheme using pre-scanning and RSS prediction in visible light communication networks", EURASIP Journal on Wireless Communications and Networking, 2013.
"Nike+ SportBand User's Guide", by nikeplus.com, Jun. 7, 2014.
"Nokia Lumia 920 pricing compared to iPhone 5 and Samsung Galaxy SIII", by Nokia, Sep. 30, 2012.
Ogawa; "Article about VLC Guidance developed", Visible Light Communications Consortium (VLCC), Aug. 31, 2012.
Ogawa; "iPhone app from Casio", Visible Light Communications Consortium (VLCC), Apr. 26, 2012.
Ogus, Simon; "SportIQ Announces a Game Changing Real-Time Basketball Analytics Platform", Sporttechie.com, Mar. 7, 2014.
"Omega introduces new timing equipment for ice hockey at Sochi 2014 Olympic Winter Games", Omega Watches, Feb. 16, 2014.
"Outdoor Laser Operations", Advisory Circular, U.S. Department of Transportation, Dec. 30, 2014.
Perin et al., Charles; "Real-Time Crowdsourcing of Detailed Soccer Data", IEEE, Oct. 2013.
Povey, Gordon, "VLC for Location, positioning and navigation", Jul. 27, 2011, http://visiblelightcomm.com/vlc-for-location-positioning-and-n . . . .
"Riddell InSite Impact Response System", Riddell InSite. Oct. 18, 2013.
Roble, Bob; "Inside the Huddle: How Big Data Is Unlocking Fantasy Football Insights", IQ Sports—Sports Technology, Sep. 3, 2013.
Saag, Tonis; "You can compare your training data with friends again", SportlyzerBlog, Feb. 20, 2013.
"What is SafeBrain", SafeBrain Systems Inc. May 14, 2014.
Schoonmaker, Aaron; "NCAA ignoring own clock recommendations in tourney", WRALSportsFan.com, Mar. 25, 2014 http://www.wralsportsfan.com/ncaa-ignoring-own-clock-recommendations-in-tourney/13510770/.
"Smartabase—The complete solution for athlete data management", Fusion Sport, www.fusionsport.com, Jul. 21, 2011.
"Sports Event Services—Quality Information is the first gold medal at any event", Infostrada Sports, May 24, 2013.
Stein, Anne; "Devices help alert teams to potential concussions on the field", Tribune Newspapers, Jun. 27, 2012.
Thanigavel, M.; "Li-Fi Technology in Wireless Communication", International Journal of Engineering Research & Technology (IJERT), ISSN: 2278-0181, vol. 2 Issue 10, Oct. 2013.
"The Head Case Impact Sensor", Head Case Company, Sep. 24, 2013.
"The System Models & How They Work", Precision Time Systems—New Inventions That Prevent Human Errors in Sports Timekeeping, Date of Download: Apr. 24, 2014.
"The Wearables Coaching an Optimal Version of You", by PSFK Labs, iQ, Feb. 24, 2014.
"Train like professional athletes", Go Pro Workouts. Date of Download: Apr. 30, 2014 https://www.goproworkouts.com/.
"Viewing other miCoach stats", Support Home Discussions Training with miCoach, Jun. 26, 2012.
WKO—Hunter Allen—Peaks Coaching Group Oct. 14, 2014.
"Wirless Whistle System", Bodet Sport, Sport Display—Timer. Date of Download: Jun. 23, 2014 file:///Cl/king/AOP/Wireless%20Whistle%20system.htm[Jun. 23, 2014 7:32:06 PM].
Won, Eun Tae; "Visible Light Communication: Tutorial", Project: IEEE P802.15 Working Group for Wireless Personal Area Networks (WPANs), Mar. 9, 2008.
"Link: Would You Like to See the Goal-Post Lengthened in Height in College Football", TideFans.com, May 6, 2014. http://www.tidefans.com/forums/showthread.php?t=222422&page=4.
PCT Application No. PCT/US2015/033613 International Search Report and Written Opinion mailed Sep. 1, 2015.
PCT Application No. PCT/US2015/040228 International Search Report and Written Opinion mailed Sep. 30, 2015.
PCT Application No. PCT/US2015/040229 International Search Report and Written Opinion mailed Oct. 1, 2015.
PCT Application No. PCT/US2015/047059 International Search Report and Written Opinion mailed Nov. 9, 2015.
U.S. Appl. No. 14/798,081 Office Action mailed Sep. 28, 2015.
U.S. Appl. No. 14/798,091 Office Action mailed Sep. 22, 2015.
U.S. Appl. No. 14/788,728 Office Action mailed Sep. 17, 2015.
U.S. Appl. No. 14/788,742 Office Action mailed Sep. 2, 2015.
U.S. Appl. No. 14/798,057 Office Action mailed Nov. 24, 2015.
U.S. Appl. No. 14/798,068 Office Action mailed Nov. 23, 2015.
U.S. Appl. No. 14/798,131 Office Action mailed Jan. 12, 2016.
U.S. Appl. No. 14/798,204 Office Action mailed Jan. 22, 2016.
U.S. Appl. No. 14/798,190 Office Action mailed Jan. 12, 2016.
U.S. Appl. No. 14/829,598 Office Action mailed Feb. 2, 2016.
U.S. Appl. No. 14/788,728 Final Office Action mailed Feb. 1, 2016.
U.S. Appl. No. 14/788,742 Final Office Action mailed Jan. 6, 2016.
U.S. Appl. No. 14/798,068 Final Office Action mailed May 5, 2016.
U.S. Appl. No. 14/798,131 Final Office Action mailed May 23, 2016.
U.S. Appl. No. 14/798,204 Final Office Action mailed May 11, 2016.
U.S. Appl. No. 14/788,742 Office Action mailed May 11, 2016.
U.S. Appl. No. 14/798,091 Office Action mailed Mar. 28, 2016.
U.S. Appl. No. 15/187,100, John E. Cronin, Smart Field Goal Detector, Jun. 20, 2016.
U.S. Appl. No. 14/798,091 Office Action mailed Aug. 18, 2016.
U.S. Appl. No. 14/798,190 Final Office Action mailed Jul. 25, 2016.
U.S. Appl. No. 14/829,598 Final Office Action mailed Jul. 18, 2016.
U.S. Appl. No. 14/788,728 Office Action mailed Jul. 13, 2016.
U.S. Appl. No. 14/798,131 Office Action mailed Sep. 20, 2016.

* cited by examiner

FIGURE 1 – Digital Whistle Game Clock and Player Signaling System

FIGURE 2 Digital Whistle Game Clock and Player Signaling System

300

FIGURE 3 – Digital Whistle Game Clock and Player Signaling System

WHISTLE PLAY STOPPER

CROSS-REFERENCE TO RELATED APPLICATIONS

The present application claims the priority benefit of U.S. provisional application No. 62/023,393 filed Jul. 11, 2014 and entitled "Whistle Play Stopper," the disclosure of which is incorporated herein by reference.

BACKGROUND OF THE INVENTION

Field of Invention

The present invention generally relates to whistles utilized by referees in sporting events. More specifically, the present invention relates to wireless actuators associated with the whistles utilized by referees in sporting events.

Description of the Related Art

In many sporting events, various individuals (e.g., officials, referees, umpires) are responsible for presiding over the game from a neutral point of view. These individuals may make numerous quick decisions directed at enforcing the rules of the respective sport they are overseeing.

In some sports (e.g., soccer, football, basketball), the various individuals may utilize whistles or other similar devices. When used by the various individuals presiding over the game, the whistle may indicate change in game phases (e.g., when a play is over) or violation of rules.

Also associated with many sporting events is the use of a timekeeper who is responsible for keeping track of the remaining time for a particular game. The remaining time may be tracked using an official game clock that can be seen by the players and bystanders alike.

In some sports (e.g., football, basketball), the operation of the game clock is associated with the signals via whistles provided by the various individuals presiding over the game. For example, a whistle can be used to indicate when the game clock should be stopped and when the game clock should resume. It may be important that the timekeeper is able to hear the signals coming from the whistle so that accurate timekeeping can be maintained.

Furthermore, it may also be equally important to ensure that the various players are capable of hearing signals via whistles. There may be many obstructions that can prevent one or more players from hearing a whistle from a single referee. For example, the player may be too far from the source or the sound from the fans/crowd may be too loud thereby drowning out the whistle sound. In these cases when one or more players are prevented from hearing the signal, this may delay the overall progression of the game. In some situations where some players have stopped play while others have not, confusion may arise and result in injuries. For example, there may be a situation where a quarterback who has heard the whistle proceeds to end the play due to a signaled in-game violation. But if one or more defensive players fail to hear the same signal, they may continue playing and proceed to tackle the quarterback. Since the quarterback was under the belief that the play had ended, the quarterback may be caught by surprise and may not take the necessary precautions to prevent injury caused by the incoming tackle.

Therefore, there is a need for a system and a method whereby signals provided by, for example, a referee in a sporting event is provided instantaneously to all the players.

There is also a need for the system and method to provide the same signal to the timekeeper so accurate timekeeping can be maintained.

SUMMARY OF THE CLAIMED INVENTION

The present invention relates to a method for notifying a game-based clock and each player associated with the sporting event using one or more digital whistles. The method includes generating a digital signal that is transmitted from the one or more digital whistles. The digital whistles generate the digital signal upon being activated by the owner of the digital whistle (e.g., an individual presiding over the sporting event such as a referee). The digital signal is transmitted to the whistle processor to be processed. The whistle processor identifies the digital signal and generates corresponding instructions that are subsequently transmitted to the game-based clock and each player associated with the sporting event. The transmitted instructions received by the clock and each player are used to inform the clock and each player that a digital whistle has been used.

A system for notifying a game-based clock and each player associated with the sporting event using one or more digital whistles is claimed. The system includes one or more digital whistles and a whistle processor. The whistle processor receives digital signals that are transmitted from one or more digital whistles. The digital whistles generate the digital signal upon being activated by the owner of the digital whistle (e.g., an individual presiding over the sporting event such as a referee). The whistle processor identifies the received digital signal and generates corresponding instructions that are subsequently transmitted to the game-based clock and each player associated with the sporting event. The transmitted instructions received by the clock and each player are used to inform the clock and each player that a digital whistle has been used.

DETAILED DESCRIPTION

The systems and methods described herein are directed towards utilizing a wireless activator alongside a whistle. The wireless activator provides a wireless signal to one or more individuals (e.g., players, time keeper) when a referee uses the whistle. In this way, the wireless signal can provide an instantaneous signal received by the one or more individuals to indicate when the play ends and also when the game clock should be stopped. The systems and methods provide a solution that overcomes the potential problem of the signals via the whistles being unheard (i.e., drowned out by the crowd).

Figure 1:
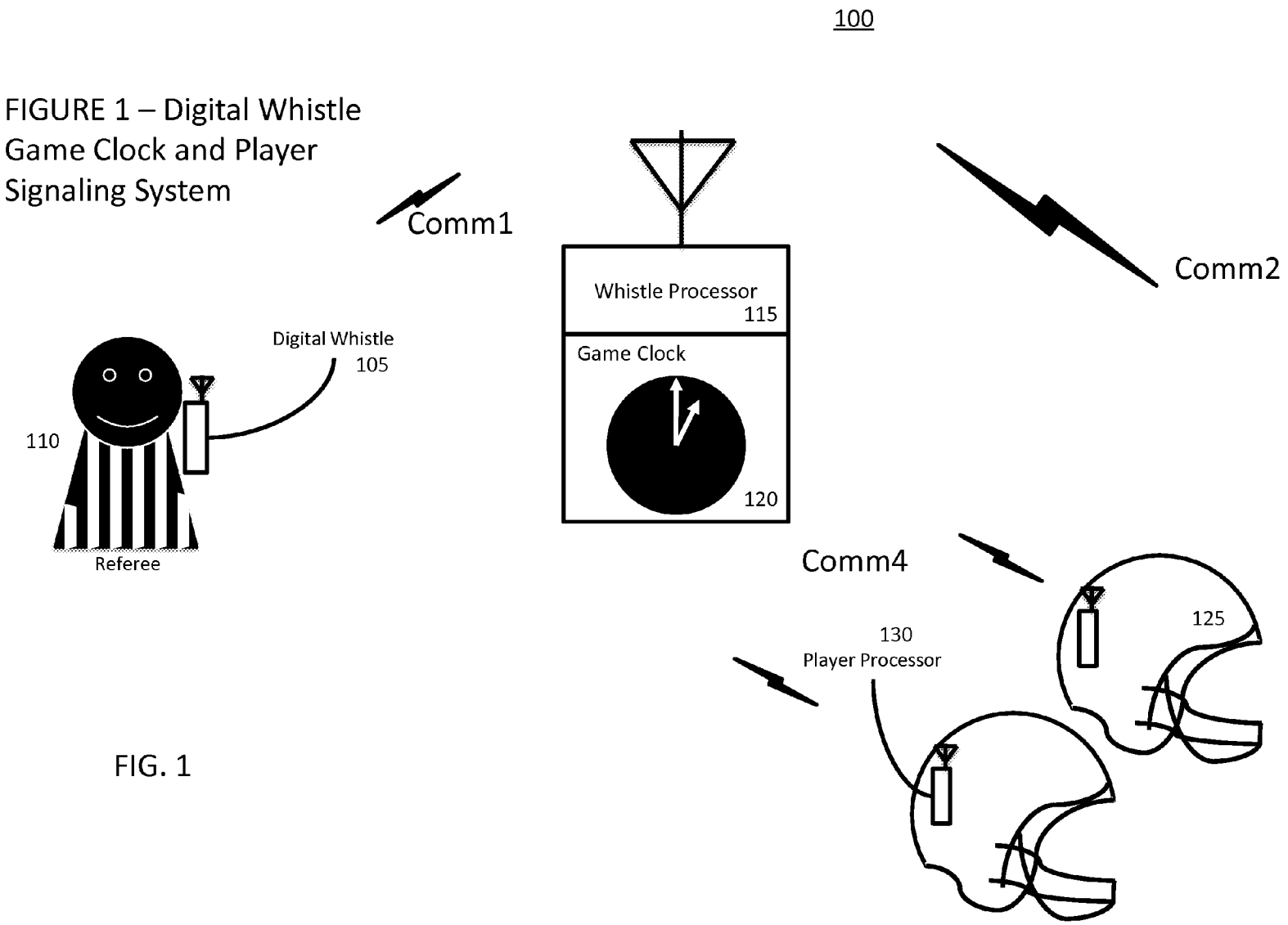
FIG. 1 illustrates a system utilizing a digital whistle.

FIG. 1 illustrates a system 100 utilizing a digital whistle 105. A referee 110 may possess and use the digital whistle 105 while presiding over the sporting event. Players 120 may have a player processor 115 situated on their body (e.g., embedded in their helmet, affixed to their uniform) adapted to receive signals from the digital whistle 105. There may also be a whistle processor 125 associated with a game clock 130 to facilitate maintaining accurate time keeping. Further details relating to the various elements of the system 100 are provided below.

As described above, the digital whistle 105 may be used by a referee 110 while the referee 110 is presiding over a particular sporting event. Much like its predecessors, the digital whistle 105 may be used to signal changes in game phases and violations of game rules. The digital whistle 105 may be a whistle that is already in use by a referee 110 presiding over sporting events currently. The digital whistle 105, however, also includes an actuator (not shown) within the digital whistle 105 that activates a wireless transmission upon the digital whistle 105 being blown by the referee 110. The actuator may be any moving or controlling mechanism that upon being triggered, for example, by the breath of the referee, initiates the wireless transmission to all possible recipients. The wireless transmission may be carried out via an antenna associated with the digital whistle 105.

The wireless transmission from the digital whistle 105 may be provided to the whistle processor 115. The whistle processor 115, as indicated above, is associated with the game clock 120. Upon receipt of the wireless transmission, the whistle processor 115 processes the received wireless transmission. The wireless processor 115 will subsequently generate instructions for the corresponding game clock 120 to pause or resume based on its previous state. For example, if the game clock was currently running, a received wireless transmission signal may indicate that the game clock should stop. Furthermore, if the game clock is currently paused, a subsequently received wireless transmission signal may indicate that the game clock should be resumed. The wireless processor 115 may check the current status of the game clock 120 prior to generating instructions for the game clock 120. In some embodiments, the wireless transmission from the digital whistle 105 may be capable of directly providing instructions to the whistle processor 115 whether the game clock should be resumed or stopped.

The whistle processor 115 also processes the received wireless signal from the digital whistle 105 in order to send a signal to each of the players 125 playing in the sporting event. In some embodiments, the whistle processor 115 may include a database of which players the received wireless signal should be provided to (e.g., the current/active players).

The wireless transmission from the whistle processor 115 is received by a player processor 130 associated with each player 125. For example, the player processor 130 may be embedded within a football helmet. In another example, the player processor 130 may be associated with the uniform (e.g., jersey, wristband) of the player 125. In any case, upon receipt of the wireless transmission from the whistle processor 115, the player processor 130 may output an indicator to the player 125 that a digital whistle 105 has been blown. For example, the player processor 130 may produce a tone that the player 125 may more easily hear since the tone would be generated closer to the particular player 125. In other situations, the player processor 130 may also provide vibrations that can be picked by the player 125. In some further situations, the player processor 130 may also provide light-based signals that can be picked up by the player 125 and surrounding players as well.

Figure 2:
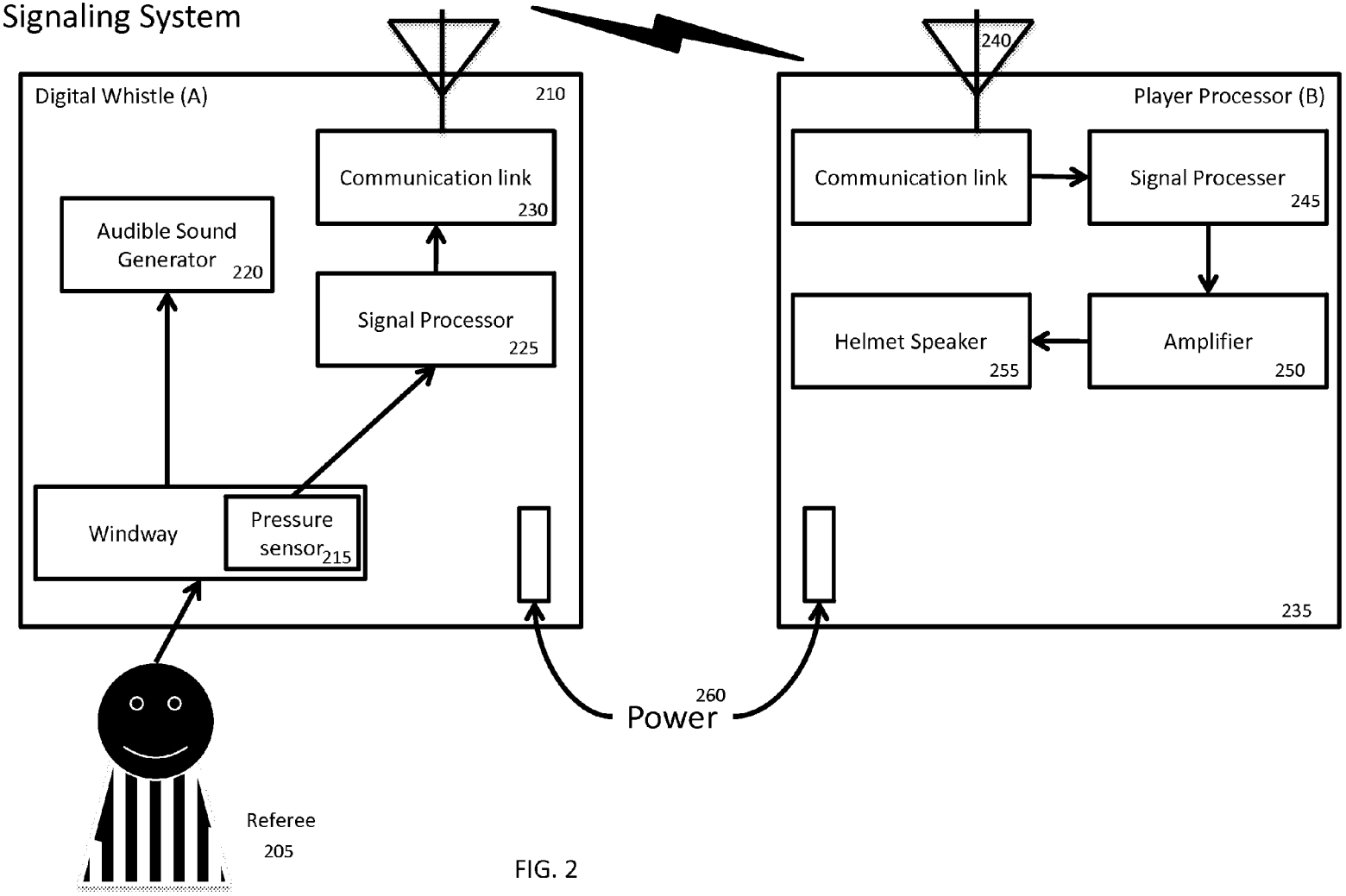
FIG. 2 illustrates a further detailed digital whistle and corresponding detailed player processor.

FIG. 2 illustrates a further detailed digital whistle 210 and corresponding detailed player processor 235. The figure illustrates how the signals provided from the referee 205 are processed by the digital whistle 210. The processed signals from the digital whistle 210 are later received by the player processor 235 associated with each player whereby the player processor 235 can be used to inform the player that the digital whistle 210 has been blown.

As illustrated in FIG. 2, the referee 205 may utilize the digital whistle 210 like any other whistle currently used by blowing into the whistle. It should be noted that other ways of utilizing the digital whistle 210 may also be possible (e.g., air pressure, steam).

Upon being blown, the air being emitted from the mouth of the referee 205 transfers into the digital whistle (i.e., windway). From the windway, the digital whistle 210 may produce an auditory tone via an audible sound generator 220 that may be similar to an auditory tone that any normal whistle currently being used may also be capable of producing.

Within the digital whistle 210, an actuator 215 (e.g., pressure sensor) may also be situated. The actuator 215 can be viewed as a switch that controls a wireless transmission from the digital whistle 210. Upon being activated, the actuator 215 may instruct the signal processor 225 to begin processing information regarding the use of the digital whistle 210 by the referee 205. For example, the signal processor 225 may evaluate how long the referee 205 blew into the digital whistle 210. It may be possible that based on the type of information obtained from the use of the digital whistle 210 by the referee 205, different types of information may be obtained and processed by the signal processor 225.

From the signal processor 225, a signal is provided to the communication link 230 of the digital whistle 210. This signal may correspond to the wireless transmission provided to the whistle processor of FIG. 1. In some embodiments, it may be possible that the wireless transmission from the communication link 230 of the digital whistle 210 is provided directly to each of the player processor 235 associated with the players participating in the sporting event.

It may be desired that the digital whistle 210 incorporate some sort of notification for the referee 205 to indicate that the digital whistle 210 received the signal from the referee 205 (e.g., blowing into the whistle). This notification (i.e., local feedback) may be provided via a tone that is generated from the audible sound generator 220 of the digital whistle 210. In some embodiments, the digital whistle 210 may provide other methods of notification (e.g., vibration, lights) that can be used to indicate that the digital whistle 210 had been blown by the referee 205.

The player processor 235, as described above, is used to facilitate notifying each of the players that the digital whistle 210 has been blown. The player processor 235, for example, may be embedded within a helmet (e.g., football helmet) used by the player. In some embodiments, the player processor 235 may be associated with the uniform or attached to the body of the players.

The player processor 235 (which may be the same as or similar to the player processor 130 illustrated in FIG. 1) includes a communication link 240. The communication link 240 facilitates the player processor 235 in receiving inputs from the digital whistle 210. The communication link 240 may also receive inputs from the whistle processor (as illustrated in FIG. 1).

Upon receipt of an input signal from the digital whistle 210 (or whistle processor) at the communication link 240, the input signal is then transmitted to the signal processor 245. The signal processor 245 then processes the input signal, for example, identifying the received input signal and preparing a corresponding output for the player (e.g., sound, light, vibrations).

The output prepared by the signal processor 245 is then provided to an amplifier 250. The amplifier 250 may be used, for example, in situations where the output is an audio-based signal, to amplify the output from the signal processor 245 into a signal that can be heard by the player via speakers 255 associated with the player processor 235. If the player processor 235 is embedded within a player helmet (e.g., football helmet), the amplifier 250 may be required to amplify the signal less since the speakers 255 may be situated in close proximity to the ears of the player. In some embodiments, the amplifier 250 may provide the amplified signal to other output elements (e.g., vibrators, lights) so that the user can be notified (e.g., vibration, flashing lights, colored lights) that the digital whistle 210 has been blown.

Each of the digital whistles 210 and player processors 235 may possess their own power supply 260. The power supply 260 is included as a way for providing power to the digital whistle 210 and player processors 235 for operation. The power supply 260 may be a rechargeable power supply (e.g., battery) that is capable of being re-charged between sporting events.

Figure 3:
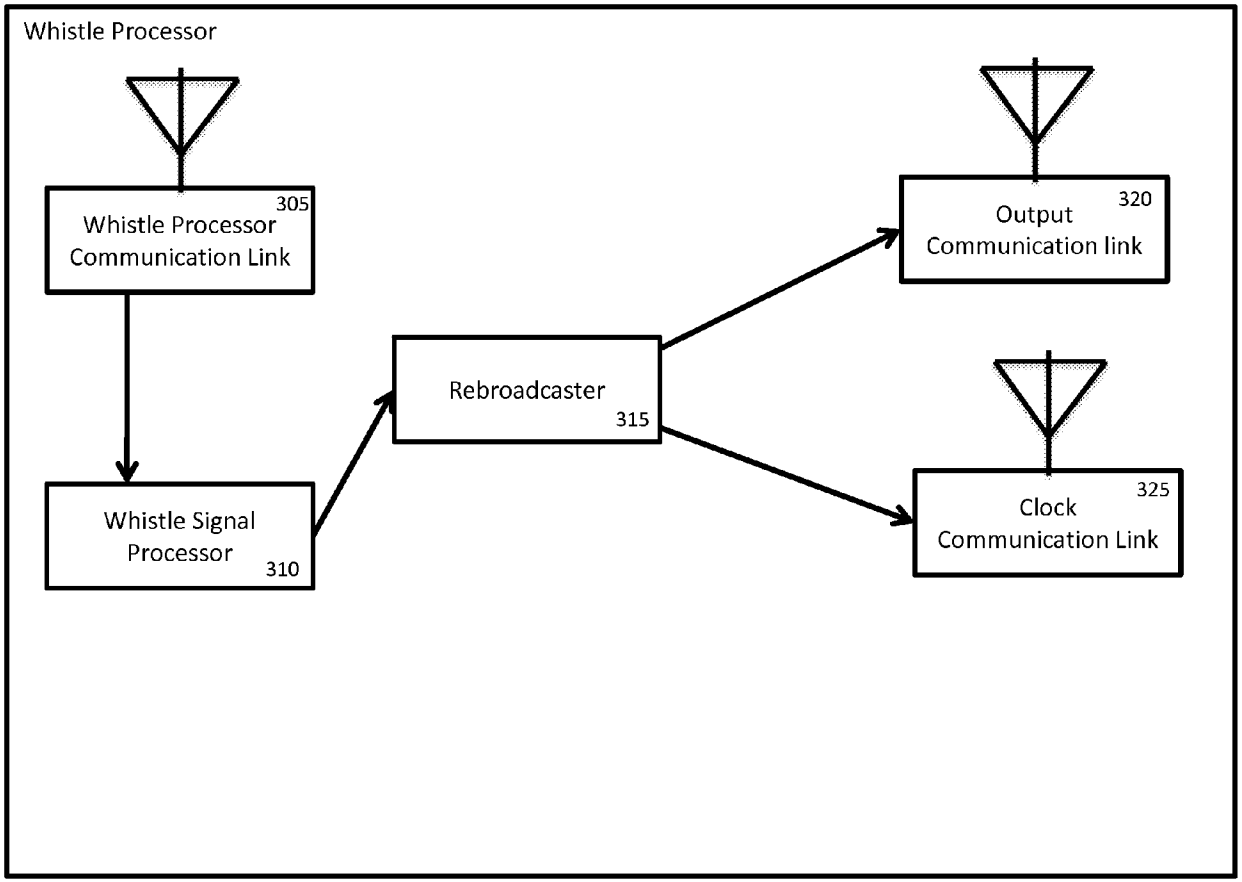
FIG. 3 illustrates a further detailed whistle processor.

FIG. 3 illustrates a further detailed whistle processor 300. The whistle processor 300 may be similar to the whistle processor 115 illustrated in FIG. 1.

The whistle processor 300 includes a communication link 305. The communication link 305 receives input signals from the digital whistle. The communication link 305 may be turned on or off based on whether the whistle processor 300 is in use. Upon receiving an input signal at the communication link 305 while the whistle processor 300 is turned on, the input signal is provided to the signal processor 310. The input signal can then be processed into an output (e.g., instructions for the clock and/or to each of the players identifying the reason why the whistle is blown). For example, based on the tone and length of the input signal from the digital signal, it may be possible for the whistle processor 300 to identify different situations for why the digital whistle is blown. It may also be possible to identify where the digital signal is being provided from (e.g., which digital whistle) thereby indicating a further layer of reasons why the digital whistle is blown. The whistle processor can utilize these possible variations in the input signal to generate corresponding instructions to match the situation as to why the digital whistle was blown and provide the instructions to the clock and/or the players accordingly.

The output from the signal processor 310 can then be provided to the rebroadcaster 315. The rebroadcaster 315 is used to shape the output from the signal processor 310 so that the output can be provided to the clock and/or players. Instructions to each of the players can be provided to the output communication link 320. Instructions to the clock can be provided to the clock communication link 325. The communication links 320, 325 facilitates providing the output signal to their associated targets (e.g., each of the players, clock).

Figure 4:
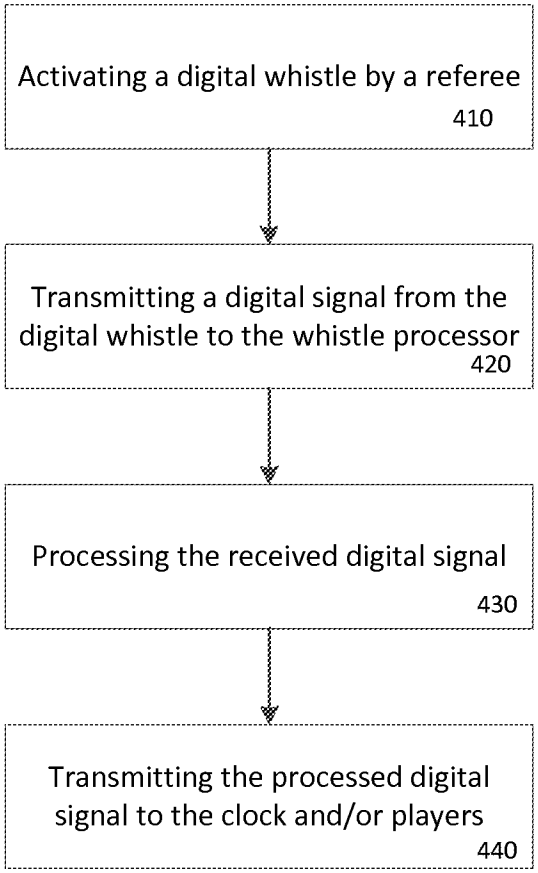
FIG. 4 illustrates a method utilizing a digital whistle.

FIG. 4 illustrates a method 400 utilizing a digital whistle. As described above, the method 400 provides a way for a digital signal to be sent from one or more referees presiding over a particular sporting event so that accurate timekeeping (via the clock) and more efficient notification of the status of the game is provided to each of the players within the game.

In step 410, one or more digital whistles are activated. The digital whistles may be used by the individuals (e.g., umpire, referee, officials) presiding over a sporting event. The referees may activate the digital whistles, for example, by blowing into the digital whistle much like existing whistles currently used. The act of blowing into the digital whistle may trigger one or more actuators that initiates a digital signal to be transmitted.

It should be noted that the digital whistle may be activated in other ways other than the act of blowing. For example, the digital whistle may have a corresponding button that the referee may press in order to trigger the actuators for the digital signal. In this way, the referee may be able to transmit a digital signal without actually blowing into the digital whistle. It should be noted that there may be other ways (aside from blowing into the whistle or pressing a button associated with the whistle) that could be used to enable a digital signal to be generated and subsequently transmitted.

In step 420, the one or more digital whistles transmit a corresponding digital signal to the whistle processor. Once the digital signal is provided an input from the referee indicating that the digital signal should be generated for an event (e.g., change in game phase or violation of game rule), the digital whistle can process the received input into the digital signal that will be transmitted. The digital signal is transmitted from the digital whistle to the whistle processor (that may be associated with one or more game clocks used for timekeeping of the sporting event) and/or each player associated with the sporting event.

The type of digital signal provided by the digital whistle may be based on the input provided by the referee. For example, different variations in breath blown into the digital whistle may be detectable. The different variations can be used to indicate different types of signals to be sent. There may be other embodiments where the digital whistle may include a plurality of buttons directed at different signals that can be generated based on the situation detected. For example, one button may be pressed when a violation is detected while a different button may be pressed when a time-out/pause in the game is initiated.

In step 430, the whistle processor processes the received digital signal from the one or more digital whistles. The digital signal received from the one or more digital whistles can signify one or more different reasons. The whistle processor may be capable of discerning the various reasons. For example, there may be a database associated with the whistle processor that the whistle processor can evaluate the received digital signal with. The database may include the various types (e.g., variations) of digital signals that may be transmitted from a digital whistle and received by the whistle processor.

In some situations, an identification of the digital whistle may also impact the situation or reason as to what the digital signal may represent. The digital signal provided from the one or more digital whistles may include identification information directed of providing additional variation as to why a digital signal is sent. The database may include the identification of the various digital whistles stored in the database and the corresponding reasons why a digital signal may have been sent from the particular digital whistle.

In step 440, the whistle processor transmits an output signal to the clock and/or each player. More specifically, once the whistle processor is able to determine why the digital signal is sent from one or more digital whistles, the whistle processor generates instructions that can then be sent to the clock and/or each player playing the sport.

Instructions to the clock may include indicating whether the clock should be stopped or re-started. In some cases, the instructions may be directed at re-adjusting a period of time that is displayed on the clock (e.g., resetting the twenty four shot clock in basketball).

The instructions to each of the players participating in the sporting event (or at least the players currently in the playing area) may be used to notify the receiving player and nearby players that the digital whistle has been blown. For example, if the player processor receives instructions from the whistle processor to end a play, the player processor may utilize its associated resources (e.g., speaker, lights, vibrator) to convey a signal that can be understood by the players to stop play. If colored lights are associated with the player processor, a red light can indicate that play should be stopped. If a speaker is used, a tone or word (e.g., stop) can be outputted so that the various players can hear. If vibrator-type devices are associated with the player processor, the vibrator can generate vibrations that the players can sense that could be used to inform them that play should stop.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

Although the specification and figures may provide various embodiments directed to use of the technology herein within the realm of American football, it should be noted that the technology can be used in a variety of different events and venues including entertainment or cultural events presented at a theater, gymnasium, stadium or other facility involving a group of people. Such events may also include a variety of sporting events such as football (American and global), baseball, basketball, soccer, ice hockey, lacrosse, rugby, cricket, tennis, track and field, golf, cycling, motor sports such as automobile or motorcycle racing, horse racing, Olympic games, and the like; cultural events such as concerts, music festivals, plays, or the opera, and the like; religious events; and more permanent exhibitions such as museums or historic homes.

What is claimed is:

1. A method for notifying a game-based clock and each player associated with the sporting event via one or more digital whistles, the method comprising:

detecting the activation of one or more digital whistles, wherein the one or more digital whistles are activated by one or more individuals presiding over the sporting event, and wherein each activated digital whistle provides one or more digital signals, wherein a location of the digital whistle alongside a variation of the one or more digital signals transmitted from the digital whistle to a whistle processor indicates at least one reason why the digital signal is being transmitted from the digital whistle to the whistle processor;

transmitting the one or more digital signals from the activated one or more digital whistles to the whistle processor and a plurality of player processors, wherein each player processor is embedded in a uniform of a different player of the sporting event;

processing, by the whistle processor and the player processors, the one or more digital signals received from the activated one or more digital whistles; and transmitting instructions from the whistle processor and the plurality of player processors, wherein the transmitted instructions from the whistle processor and the plurality of player processors correspond with the received digital signals from the activated one or more digital whistles, and wherein the transmitted instructions from each of the player processors outputs a corresponding indicator to the respective different player uniform.

2. The method of claim 1, wherein activation of the one or more digital whistles includes blowing into the digital whistle or pressing a button associated with the digital whistle.

3. The method of claim 1, wherein activation of the one or more digital whistles includes triggering an actuator.

4. The method of claim 1, wherein the one or more digital whistles associated with the one or more individuals presiding over the sporting event each has unique identification information.

5. The method of claim 1, wherein the processing of the received digital signals includes evaluating the received digital signal against digital signals stored in a database of the whistle processor.

6. The method of claim 5, wherein the database includes information about received digital signals, identification information related to variations of the one or more digital whistles that sends digital signals and one or more reasons why the digital signal variation was provided, the reasons corresponding to instructions transmitted to the one or more receivers.

7. The method of claim 1, wherein the one or more receivers includes a clock, the clock being instructed to stop or resume based on the received instructions from the whistle processor.

8. The method of claim 1, wherein the one or more receivers includes processors associated with each of the players playing in the sporting event, the processors for triggering one or more indicators used to indicate to the player that the digital whistle has been blown.

9. The method of claim 8, wherein the indicators include lights, vibrators and speakers.

10. A system for notifying a game-based clock and each player associated with the sporting event via one or more digital whistles, the system comprising:

one or more digital whistles;

a whistle processor comprising a processor and memory that includes instructions to:

receive one or more digital signals transmitted from the digital whistles, wherein the digital whistles have been activated by one or more individuals presiding over the sporting event, and wherein each activated digital whistle provides one or more digital signals, wherein a location of the digital whistle alongside a variation of the one or more digital signals transmitted from the digital whistle to the whistle processor indicates at least one reason why the digital signal is being transmitted from the digital whistle to the whistle processor, process the one or more digital signals transmitted from the activated one or more digital whistles, and transmit instructions, wherein the transmitted instructions corresponds with the received digital signals from the digital whistle; and a plurality of player processors, wherein each player processor is embedded in a uniform of a different player of the sporting event, and wherein each player processor processes the one or more digital signals transmitted from the digital whistles to output an indicator to the respective different player uniform.

11. The system of claim 10, wherein activation of the one or more digital whistles includes blowing into the digital whistle or pressing a button associated with the digital whistle.

12. The system of claim 10, wherein activation of the one or more digital whistles includes triggering an actuator.

13. The system of claim 10, wherein the one or more digital whistles associated with the one or more individuals presiding over the sporting event each has unique identification information.

14. The system of claim 10, wherein the processing of the received digital signals includes evaluating the received digital signal against digital signals stored in a database of the whistle processor.

15. The system of claim 14, wherein the database includes information about received digital signals, identification information related to variations of the one or more digital whistles that sends digital signals, and one or more reasons why the digital signal variation was provided, the reasons corresponding to instructions transmitted to the one or more receivers.

16. The system of claim 10, wherein the one or more receivers includes a clock, the clock being instructed to stop or resume based on the received instructions from the whistle processor.

17. The system of claim 10, wherein the one or more receivers includes processors associated with each of the players playing in the sporting event, the processors for triggering one or more indicators used to indicate to the player that the digital whistle has been blown.

18. The system of claim 17, wherein the indicators include lights, vibrators and speakers.

* * * * *